United States Patent [19]

Kikuchi

[11] Patent Number: 4,964,382

[45] Date of Patent: Oct. 23, 1990

[54] PISTON FOR TWO-CYCLE INTERNAL COMBUSTION ENGINE

[75] Inventor: Satoru Kikuchi, Fussa, Japan

[73] Assignee: Kioritz Corporation, Tokyo, Japan

[21] Appl. No.: 414,169

[22] Filed: Sep. 28, 1989

[30] Foreign Application Priority Data

Oct. 19, 1988 [JP] Japan ..... 63-261691

[51] Int. Cl.[5] ..... F02B 33/04

[52] U.S. Cl. ..... 123/73 AA; 123/193 P

[58] Field of Search ..... 123/73 AA, 73 FA, 193 P

[56] References Cited

U.S. PATENT DOCUMENTS

| | | | |
|---|---|---|---|
| 890,335 | 6/1908 | Claus | 123/73 AA |
| 993,939 | 5/1911 | Adams | 123/73 AA |
| 1,733,361 | 10/1929 | Rice | 123/73 AA |
| 1,755,260 | 4/1930 | Johnson | 123/73 AA |
| 4,458,636 | 7/1984 | Kania | 123/73 R |

FOREIGN PATENT DOCUMENTS

| | | | |
|---|---|---|---|
| 748335 | 12/1944 | Fed. Rep. of Germany | 123/73 AA |
| 937382 | 1/1956 | Fed. Rep. of Germany | 123/73 AA |
| 937445 | 1/1956 | Fed. Rep. of Germany | 123/73 AA |
| 338894 | 8/1904 | France | 123/73 AA |
| 926390 | 9/1947 | France | 123/73 AA |
| 1022403 | 3/1953 | France | 123/73 AA |
| 584819 | 11/1958 | Italy . | |
| 60-55753 | 4/1985 | Japan . | |

*Primary Examiner*—David A. Okonsky

*Attorney, Agent, or Firm*—Browdy and Neimark

[57] ABSTRACT

The present invention provides a piston for a two-cycle internal combustion engine in which a hole is disposed at a position upwardly remote from a lower end of a skirt portion, which position corresponds to a position of an inlet port.

4 Claims, 2 Drawing Sheets

PISTON FOR TWO-CYCLE INTERNAL COMBUSTION ENGINE

BACKGROUND OF THE INVENTION

The present invention relates to a piston for a two-cycle internal combustion engine.

Among two-cycle internal combustion engines for portable-type power-driven working machines, there is one constructed in such a manner that a lower end of a skirt portion of a piston reciprocating within a cylinder passes an opening portion of an inlet port defined on the cylinder to open and close the inlet port, thereby allowing an air-fuel mixture to flow from the inlet port through a lower space of the cylinder into a crankcase, as well as shutting off the same. Conventionally, a piston used in such internal combustion engine is ordinarily provided with a plane end edge at a lower end of its skirt portion. Because the plane lower end edge opens and closes the inlet port of the cylinder, when the piston reciprocates upwardly and downwardly within the cylinder, the lower end edge of the skirt portion of the piston opens and closes the inlet port rapidly. For this reason, an abrupt pressure change is caused at that portion and large pressure wave is generated, which results in a problem that a considerably high-level intake noise is caused from the engine. In order to solve this problem, there is known a piston or a cylinder which is adapted to gradually open and close the inlet port at the primary stage during opening and closing the opening of the inlet, by forming a notch at a lower end of a skirt portion of the piston or an inlet port of the cylinder, whereby the occurrence of a high-level intake noise is restrained. However, such a structure that the notch is provided on the piston or the cylinder is difficult to be manufactured and a strength of the portion where the notch is provided is weakened, so that there is some problems, for example, an unexpected early breakage of the piston or the cylinder is apt to occur.

SUMMARY OF THE INVENTION

For the purpose of solving such problems of the prior art, an object of the present invention is to provide a piston for a two-cycle internal combustion engine in which an intake noise is suppressed and a high durability is obtained, the structure is simple so that it is easy to be manufactured, and a modification can easily be made to a conventional piston.

That is to say, according to the present invention, a piston for a two-cycle internal combustion engine is characterized in that it is constructed in such a manner that a hole is provided at a position upwardly remote from a lower end of a skirt portion of the piston, which position corresponds to a position of an inlet port of a cylinder.

Thus, when the piston rises from the side of bottom dead center, the hole initiates to open the inlet port and, then the lower end of the skirt portion completely opens the inlet port. To the contrary, when the piston is moving down, the hole at the lower end of the skirt portion is aligned with the inlet port prior to the skirt portion completely closes the inlet, whereby an abrupt pressure variation between the hole and the inlet port is decreased, so that the amplitude of pressure wave can be moderated.

By the above-described structure of the present invention, the sudden pressure change across the inlet port of the two-cycle internal combustion engine is minimized so as to suppress the intake noise, and the high durability of the piston is improved. The structure of the piston according to the invention is so simple as to be readily manufactured, and a modification can easily be made to a conventional piston.

PREFERRED EMBODIMENT OF THE INVENTION

A preferred embodiment of the present invention will be described hereinafter with reference to the drawings.

Figure 1:
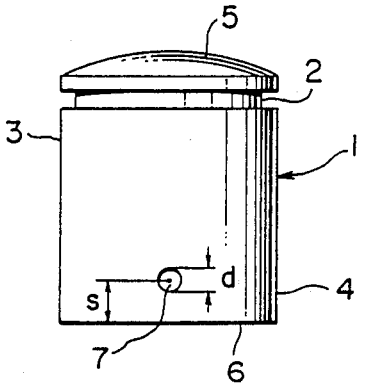
FIG. 1 is a side view showing one embodiment of a piston for a two-cycle internal combustion engine according to the present invention.

FIG. 1 shows a piston 1 of one embodiment according to the invention, which piston is provided with a head portion 3 having a circumferential groove 2 onto which a piston ring (not shown) is mounted and with a hollow skirt portion 4 formed integrally in communication with a lower portion of the head portion 3. An upper end 5 of the head portion 3 is closed, and a lower end 6 of the skirt portion 4 is opened to the side of a lower crankcase (not shown), defining a plane end edge over its overall circumference. The above-mentioned piston 1 has the same structure as a conventional piston. However, the piston 1 of the embodiment of the invention in FIG. 1 is formed with a circular hole 7 radially penetrating therethrough at a position upwardly remote from the lower end 6 of the skirt portion 4 of the piston 1 by drilling process. It is preferable that the hole 7 is settled, whose diameter d is 4 mm and whose distance s from the lower end 6 of the skirt portion 4 to the center of the hole 7 is 8 mm, for example, in a two-cycle internal combustion engine which displacement is substantially 40 cc.

Figure 2:
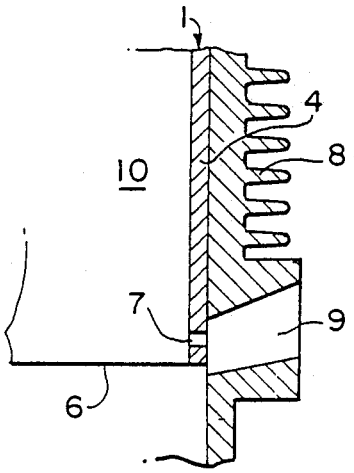
FIG. 2 is a cross-sectional view of an essential portion of the embodiment showing a state where the piston of FIG. 1 is disposed within a cylinder.

The piston 1 constructed in this way is inserted into a cylinder 8 as shown in FIG. 2 in such a manner that the hole 7 of the piston 1 is located at a position corresponding to the position of an inlet port 9 defined on the cylinder 8. The piston 1 thus located is reciprocated upwardly and downwardly within the cylinder 8 during driving of the engine, while the hole 7 displaces up-down across over the inlet port 9. When the piston 1 moves upwardly from the side of bottom dead center, the hole 7 having an opening area much smaller than that of the inlet port 9 begins to move across the inlet port 9 from its lower side to the upper side while the inlet 9 begins to communicate with an internal space 10 of the skirt portion 4 of the piston 1 through the hole 7, so that a pressure difference between the inlet port 9 and the internal space 10 of the skirt portion 4 of the piston 1 can be provisionally decreased continuously. Under these conditions, the lower end 6 of the skirt portion 4 of the piston 1 moves beyond the inlet port 9 into full-open condition, thereby making it possible to sufficiently introduce an air-fuel mixture from the inlet port 9 into the crankcase. As described above, the inlet port 9 is gradually opened by the hole 7 of the skirt portion 4 of the piston 1, moderating an abrupt pressure change generated at the opened area and weakening pressure wave, so that an intake noise is minimized and a decrease in output due to blowing back of the air-fuel mixture can be restrained to a minimum. To the contrary, when the piston 1 moves downwardly, the inlet port 9 is gradually closed, to thereby moderate the abrupt pressure change. Further, since the lower end 6 of the skirt portion 4 of the piston 1 is provided with the plane end edge over the overall circumference, a decrease in strength is not caused and an early breakage of the piston 1 is prevented.

Figure 3:
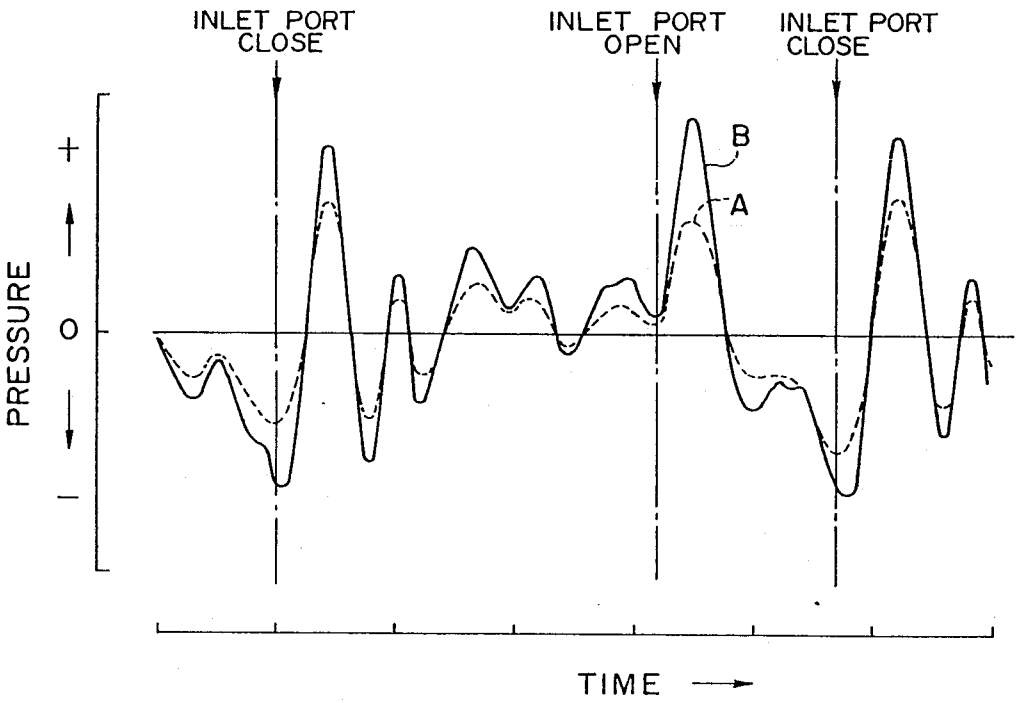
FIG. 3 is a diagram showing pressure wave forms in the vicinity of an inlet port in the cases where the piston of the embodiment of the invention and a conventional piston are used, respectively.

Referring next to FIG. 3, it illustrates a result of actual measurement of pressure wave forms in the vicinity of the inlet port 9 in the cases where the piston 1 in the above-described embodiment is utilized and where a conventional piston which is not provided with the hole 7 is ordinarily used. In FIG. 3, a dotted line A designates a pressure wave form when the piston 1 with the hole 7 of the embodiment is employed, and a solid line B designates a pressure wave form when the conventional piston not having a hole is used. It is understood from FIG. 3 that a pressure change in the vicinity of the inlet port in the case of the piston of the invention is rather smaller in comparison with that in the case of the conventional piston, and it is confirmed that the noise of the former is actually lower by 2 db(A) than that of the latter. In addition, a configuration and the diameter d of the hole 7, and the above-mentioned distance s can be settled appropriately so as to be most suitable for the kinds, required performance and application of the engines.

What is claimed is:

1. A piston reciprocating in a cylinder having a cylinder wall for a two-cycle internal combustion engine, characterized in that a hole is provided in the piston at a position upwardly remote from a lower end of a skirt portion, which position corresponds to a position of an inlet port in the cylinder wall, and said hole has an opening area much smaller than that of said inlet port.

2. A piston according claim 1, wherein a diameter of said hole is half a distance from the lower end of said skirt portion to the center of the hole.

3. A piston reciprocating in a cylinder having a cylinder wall for a two-cycle internal combustion engine and a crank case, characterized in that a hole is provided in the piston at a position upwardly remote from a lower end of a skirt portion, which position corresponds to a position of an inlet port in the cylinder wall leading to the crank case; and wherein a diameter of said hole is half a distance from the lower end of said skirt portion of the center of the hole and smaller in diameter than said port.

4. A piston reciprocating in a cylinder in accordance with claim 3 wherein the hole position corresponds to a position of an inlet port.

* * * * *